US005345069A

United States Patent [19]

Grindrod

[11] Patent Number: 5,345,069

[45] Date of Patent: Sep. 6, 1994

[54] MICROWAVABLE FROZEN IMPACT-RESISTANT HERMETICALLY SEALED FOOD PACKAGE

[75] Inventor: Paul E. Grindrod, Madison, Wis.

[73] Assignee: Oscar Mayer Foods Corporation, Madison, Wis.

[21] Appl. No.: 761,153

[22] Filed: Sep. 17, 1991

[51] Int. Cl.[5] ..... H05B 6/80

[52] U.S. Cl. ..... 219/730; 219/725; 219/731; 99/DIG. 14; 426/103; 426/107; 426/234; 426/243; 428/412

[58] Field of Search ..... 219/10.55 E, 10.55 R, 219/10.55 F; 99/DIG. 14; 428/349, 34.8, 36.7, 412; 426/123, 127, 129, 113, 412, 413, 415, 234, 243, 109, 107

[56] References Cited

U.S. PATENT DOCUMENTS

| | | | |
|---|---|---|---|
| 3,442,686 | 5/1969 | Jones | 428/412 |
| 3,667,452 | 6/1972 | Brebant et al. | 126/390 |
| 3,740,237 | 6/1973 | Grindrod et al. | 206/484 |
| 3,997,677 | 12/1976 | Hirsch et al. | 426/113 |
| 4,273,815 | 6/1981 | Gifford et al. | 428/35 |
| 4,368,292 | 1/1983 | Alberts et al. | 525/54.23 |
| 4,409,775 | 10/1983 | Brody et al. | 53/167 |
| 4,684,025 | 8/1987 | Copland et al. | 206/484 |
| 4,740,377 | 4/1988 | Dawes et al. | 426/234 |
| 4,782,951 | 11/1988 | Griesbach et al. | 206/484 |
| 4,788,105 | 11/1988 | Mueller et al. | 428/412 |
| 4,823,961 | 4/1989 | Griesbach et al. | 206/632 |
| 4,903,842 | 2/1990 | Tokuda et al. | 206/604 |
| 4,915,963 | 4/1990 | Lustig et al. | 426/113 |
| 4,925,684 | 5/1990 | Simon | 426/107 |
| 4,939,332 | 7/1990 | Hahn | 219/10.55 E |
| 4,965,108 | 10/1990 | Biel et al. | 428/35.7 |
| 4,965,109 | 10/1990 | Tucker et al. | 428/35.7 |
| 5,005,707 | 4/1991 | Hustad et al. | 206/632 |
| 5,006,378 | 4/1991 | Itaba et al. | 428/34.9 |
| 5,014,856 | 5/1991 | Griesbach et al. | 206/632 |
| 5,037,700 | 8/1991 | Davis | 428/414 |
| 5,050,736 | 9/1991 | Griesbach et al. | 206/484 |
| 5,051,266 | 9/1991 | Juhl et al. | 426/129 |
| 5,107,658 | 4/1992 | Hustad et al. | 53/408 |

FOREIGN PATENT DOCUMENTS

| | | |
|---|---|---|
| 054857 | 6/1982 | European Pat. Off. . |
| 282773 | 9/1988 | European Pat. Off. . |
| 2115770 | 9/1983 | United Kingdom . |

*Primary Examiner*—Bruce A. Reynolds
*Assistant Examiner*—Tu Hoang
*Attorney, Agent, or Firm*—Joseph T. Harcarik

[57] ABSTRACT

A gas-flushed microwavable easy-to-open food package is provided which is resistant to impact under temperatures at or below freezing and which is comprised of a flexible lidding film having oxygen-barrier properties hermetically and peelably sealed to a food compartment formed from a polypropylene copolymer material. The lidding film is preferably comprised of oriented polyester, and the food product compartment further comprises a peelable oxygen, barrier film, preferably formed of ethylene vinyl acetate, PVDC and a peelable polyethylene layer. The package is designed to contain a perishable food product, such as a wiener in a bun or other proteinaceous-farinaceous food combinations, and is preferably entirely or partially transparent so as to allow the consumer to readily observe the condition of the food product before purchase. The package is particularly advantageous in that it provides impact protection and maintains freshness for a food product that is shipped frozen and kept at refrigeration temperatures near point of sale, and can also be microwaved to serving temperatures without thermal distortion.

30 Claims, 1 Drawing Sheet

FIG. 1
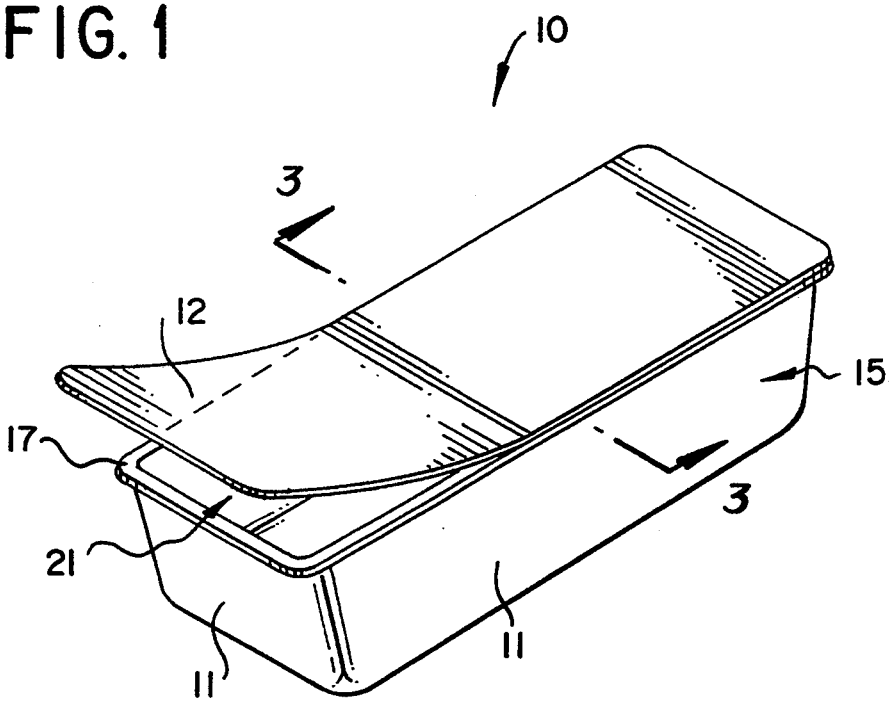
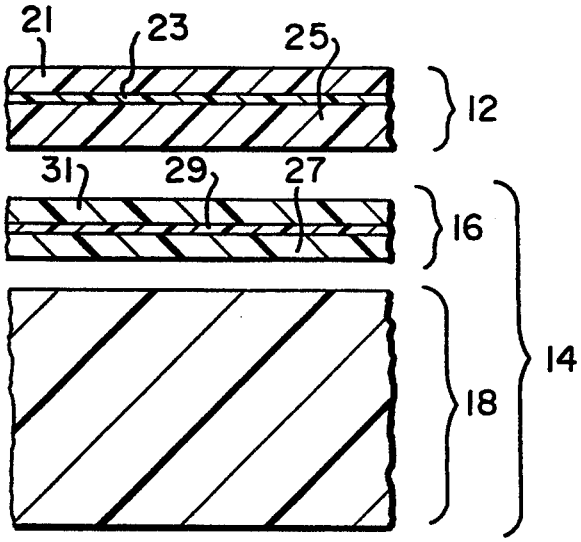
FIG. 2
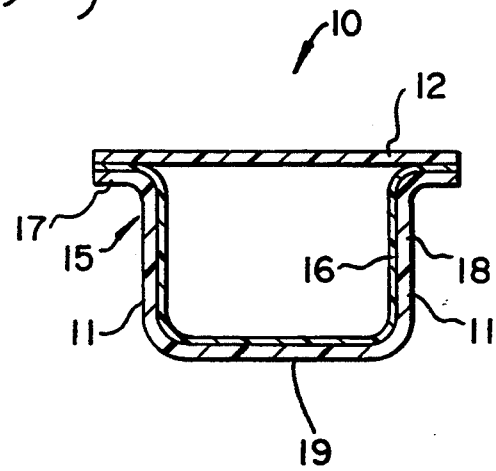
FIG. 3

MICROWAVABLE FROZEN IMPACT-RESISTANT HERMETICALLY SEALED FOOD PACKAGE

FIELD OF THE INVENTION

The invention relates to a gas-flushed microwavable food package which is impact-resistant while frozen and which is comprised of a lidding film having oxygen-barrier properties hermetically sealed to a food compartment that is sufficiently rigid to be handled at all temperatures from 0° to 200° F.

BACKGROUND OF THE INVENTION

At present, supermarkets, convenience stores and a variety of other places where refrigerated foods are available are competing with restaurants and fast-food establishments by providing an assortment of ready-made sandwiches and other lunchtime or dinnertime products. Most often, these packages enclose rapidly perishable food products such as a frankfurter or wiener in a bun or other proteinaceous-farinaceous food combinations which are subject to rapid degradation, particularly if the package is torn or bruised. Since these packages are usually transparent so that the potential consumer can observe product quality, the degradation of the meat product or the staling or molding of the bread will be readily apparent to the consumer and the product will go unsold.

It is thus of primary importance that packages be developed which can maximize freshness and which can be made sturdy enough to avoid the problems associated with bumping and bruising of food products during transport and handling. This has particularly been a problem with transparent sandwich-type packages that have to be frozen at some point before sale in order to protect the rapidly perishable food product contained inside. Typically, at the below-freezing low temperatures normally associated with the processing of such food products, commonly around 0° F., the tendency for these food packages to bruise or break is greatly increased, and such damage will typically result in the spoilage of the food product, particularly when it is thawed.

Additionally, it is often the case that these perishable sandwiches or other food products will be of the type that have to be heated before being consumed, for example, in a microwave oven. It is thus quite important that packaging for such food items be capable of withstanding the conditions associated with microwaving without undergoing thermal distortion.

Although there have been attempts to develop frozen food packages which could be heated to microwave temperatures, these prior packages suffered from various drawbacks including lack of an adequate oxygen barrier which greatly restricted shelf life. Additionally, these packages were not made with easy-to-open peelable lids, and thus removal of the product from the packages was extremely difficult. As a result of these drawbacks, the prior freezer-to-microwave packages were extremely limited in function and consumer suitability, and could not be used to preserve a product that was frozen then thawed to a refrigerated state.

An example of this prior package is disclosed in U.S. Pat. No. 3,997,677 (Hirsch et al). The Hirsch et al. patent discloses a hermetically sealed plastic package that can retain a frozen food product and then be microwaved to serving temperatures. The package essentially utilized any one of three materials, polycarbonate, polypentamethylene or polysulfone, none of which is economically feasible to use today. In fact, the hazy, milky medium and high density polyethylenes disclosed in Hirsch are unsuitable for use in a transparent package. The Hirsch package was constructed utilizing the then existing technology of hermetically sealed plastic moisture barrier packages, and simply comprised adding a thermally stable ply to well-known commercially available packaging materials using conventional sealing techniques. The package does not provide oxygen impermeability, and none of the materials it uses are oxygen barriers capable of preventing permeation of oxygen above freezing. Use of the materials described in the Hirsch patent without suitable oxygen barrier layers results in discoloration, oxidative rancidity, and flavor degradation of the food product at temperatures above freezing.

Another problem with the package described in the Hirsch patent is that it provided no means whereby the package could be easily opened. In the package embodiments disclosed, a polyolefin (medium or high density polyethylene or polypropylene) was fusion sealed to a like polyolefin, and thus there was no capability for peeling the package open. The Hirsch package was openable only by cutting or tearing, and a weakened area was provided which comprised a narrowed fused seal that needed to be torn open. Without an easy-open, peelable feature, the Hirsch package was unsuitable for consumer use because its fused seal necessitated opening in an erratic and unreliable manner even when using a sharp tool such as a knife. The drawbacks of prior packages such as those disclosed in the Hirsch patent have thus resulted in their being of limited functionality and effectiveness, and more suitable and versatile freezer-to-microwave packages are highly desired.

There thus exists a need for a peelably sealed, easy-to-open transparent package for containing a perishable food product which can maintain the freshness of the product while frozen and while the product is thawed and kept at refrigerated temperatures, and which can still withstand conditions of a microwave oven so that the product can be cooked without thermal degradation or melting of the package.

SUMMARY OF THE INVENTION

It is a purpose of the present invention to provide a new and improved food package which is both freezable and microwavable.

This purpose of the invention is achieved by providing a microwavable impact-resistant hermetically-sealable easy-to-open food package which will withstand impact at temperatures at or below freezing and prevent loss of moisture and oxygen permeation while kept under refrigeration. The package preferably comprises a lidding film having oxygen-barrier properties that is hermetically and peelably sealed to a tray-type food compartment comprised of a polypropylene copolymer or other suitably resistant material. The lidding film is preferably comprised of a highly impact-resistant material such as oriented polyester and the polypropylene copolymer food compartment preferably further comprises a peelable oxygen barrier film.

The food compartment of the package is preferably thermoformed from a laminate of a thick polypropylene copolymer sheet and a thin peelable oxygen barrier film which is either heat or adhesively laminated to the thick sheet. The lidding film is then preferably heat sealed to the food compartment to seal a food product and to provide the freezable and microwavable package of the invention. If desired, anti-fog additives can be added to the lidding film to give a package having anti-fog properties.

The present invention thus provides for the first time a transparent, hermetic gas-packed oxygen-barrier package for a perishable food product which can be safely frozen for shipping and storage, stored at refrigeration temperatures near point of sale, microwaved to heat the food product stored in the food compartment, and easily peeled open to remove the food product.

It is thus an object of the present invention to develop an easy-to-open microwavable transparent package for a perishable food product that will be stored and shipped at freezing temperatures, thawed and stored at refrigeration temperature near the point of sale, and ultimately cooked in a microwave oven.

It is also an object of the present invention to provide a transparent microwavable food package which is highly resistant to impact at low temperatures around or below freezing, yet which is also stable at microwave temperatures.

It is still further an object of the present invention to provide a transparent or partially transparent package which is resistant to thermal distortion during microwave heating, which is hermetically sealable and peelable, and which provides an effective oxygen barrier for the food compartment under a broad range of temperatures.

BRIEF DESCRIPTION OF THE DRAWINGS

The preferred embodiments of the present invention will now be described with reference to the accompanying drawings, wherein:

FIG. 1 is a perspective schematic view of a package employing the present invention.

FIG. 2 is an exploded cross-sectional view of the components of the package of FIG. 1.

FIG. 3 is a cross-sectional view of the package of FIG. 1 taken along the plane of the line 3—3.

DETAILED DESCRIPTION OF THE PREFERRED EMBODIMENTS

A package in accordance with the present invention is shown in FIGS. 1–3 with like numerals indicating like elements in the different views. As best shown in FIGS. 1 and 2, the package 10 of the invention is primarily comprised of flexible lidding film 12 which is hermetically and peelably sealed to a food compartment 14 made of a thermoformed packaging material. Lidding film 12 is comprised of any material which has the ability to withstand normal impact at low temperatures, even those at or below freezing, which can substantially prevent the transmission of oxygen and moisture, and which can be heated in a microwave oven without thermal distortion. In the preferred embodiment, as will be explained further below, lidding film 12 is comprised of any suitable material that has sufficient mechanical strength so as to withstand normal impact.

The food product compartment 14 is formed from any suitable material which can withstand impact at low temperatures and yet resist thermal deformation while being microwaved. Particularly suitable are transparent polypropylene copolymers, as will be explained in more detail below. Food compartment 14 preferably further comprises a peelable oxygen barrier layer 16 which will preferably be either heat sealed or adhesively laminated to polypropylene copolymer section 18 of food compartment 14. The compartment 14 is shaped so as to enclose a particular food product, and will thus have a bottom panel 19, sidewalls 11, and an upper opening 21 which is sealed by the lidding film 12. In the embodiment observed in FIG. 1, the compartment 14 is shaped to contain a frankfurter or wiener in a bun product.

In the preferred embodiment, the food compartment is in the form of a package tray 15 which includes tray peripheral flange 17 which completely surrounds the package opening and provides support for lidding film 12. As shown in the embodiment of FIG. 1, the tray 15 can be formed in the shape of a rectangular box as would be necessary for containing a frankfurter or wiener in a bun as the food product. However a variety of other food products, including sandwiches, pizza, egg rolls, etc., would also be suitable for packaging in the present invention, and such packages would be sized and shaped accordingly. It is contemplated that the present invention will have particular utility in housing proteinaceous-farinaceous food combinations since these food products are generally quite susceptible to degradation if not properly handled and refrigerated.

The package tray 15 of the present invention which forms a compartment for food products is preferably made of a material that can withstand impact at 0° F. yet is also resistant to thermal deformation at microwaving temperatures. Additionally, the tray must exhibit sufficient rigidity so that it can be handled without collapsing at all temperatures in the range of from about 0° to 200° F., and preferably the tray will also be laminable or sealable to a peelable oxygen barrier film. It is also preferred that the tray be of sufficient clarity and transparency so that the food product quality can be readily assessed. However, if desired, the tray 15 can be made of a suitable opaque material, and the lidding film can be made transparent to allow the consumer to visually assess the quality of the food product. Conversely, if the package tray is transparent, then the lidding film can be made from a suitable opaque material, and the consumer will still be able to see the condition of the food.

In accordance with the objects of the present invention, it has been discovered that crosses between polyethylene and polypropylene, more accurately referred to as polypropylene copolymers, are suitable for use in forming a food product compartment that has the requisite qualities to be both freezable and microwavable. These polypropylene copolymers successfully combine the positive physical attributes of the two polymers so as to obtain a hybrid polymer with the required qualities of good clarity, freezer impact strength, and resistance to thermal deformation in a microwave. Examples of polypropylene copolymers that are suitable for use as the package tray of the invention include resins 9231, PP6310 and PP9403 manufactured by Rexene, resins SD 613, RMN-020, SD314 and 7823 by Himont, Fortilene 4114 by Soltex, Eastman Kodak's Tenite (HDT), and resin 7300KF by Quantum.

Polypropylene copolymers are the preferred embodiment with regard to the tray of the present invention because they are economical and easy to thermoform. However, any other materials known in the art which have the same physical characteristics are also suitable for use in the invention. For example, materials such as polycarbonates, cellulose acetate-butyrate and ethocell are also suitable, although these materials will fill the tray requirement at a higher cost.

The package tray 15 is preferably thermoformed after a process that applies a thin peelable oxygen barrier film 16 over the thick polypropylene layer 18. It is preferred that barrier film 16 be heat sealed or adhesively laminated to the polypropylene copolymer 18. In the preferred embodiment, the tray 15 is preformed on a large multiple unit thermoformer, after which it can be stacked, boxed and sent to the point of packaging. If desired, the tray can be thermoformed in the packaging process if a form-fill-seal machine (such as Multivac or Tiromat) is employed. Before the lidding film 12 is applied to seal the product in the food compartment, it is preferred that the compartment be gas-flushed (or vacuumed) and hermetically sealed by any of the various conventional methods known and used in the art. As a result of these steps, the package thus formed will provide a hermetically sealed, gas-packed food product compartment that excludes oxygen and prevents the loss of moisture.

In the preferred embodiment, lidding film 12 is made up of materials which provide both impact strength and oxygen-barrier properties, and which can be peelably sealed directly to food compartment 14. The lidding film 12, will form an impact-resistant oxygen barrier seal which can be easily removed from the package tray by peeling when the food product is to be consumed. Preferably, the lidding film 12 is comprised of any suitable transparent, peelable, oxygen-impermeable material which will be able to avoid impact damage even at temperatures at or below freezing and which will thus provide sufficient mechanical strength to the package so that it can be peeled without rupture. In the preferred embodiment, as best observed in FIG. 2, the mechanical strength of the lidding film is provided by an outer layer 21 of polyester film (particularly oriented polyester) which has outstanding strength and stability in thin gauges. The preferred thickness of the polyester film layer is from about ¼ to 2 mils, with about ½ mil particularly preferred. It is also suitable to use a nylon film which can be amorphous or oriented. Oriented nylon films are somewhat preferable because of their excellent strength and flexibility.

In addition, it is also possible to provide the lidding film 12 with a coating layer 23, also as observed in FIG. 2, which preferably provides an oxygen barrier with a preferred permeability of no greater than about 1 cc of oxygen per 100 square inches per 1 atmosphere pressure differential at room temperature. In the preferred embodiment, coating 23 is comprised of a layer of polyvinylidene dichloride (PVDC or Saran) of generally about 1/20 to 1/10 of a mil in thickness. The coating layer 23 can be applied by any of a number of conventional coating methods known and used in the art. It is also possible to employ as the coating layer 23 an extruded EVOH (ethylene vinyl alcohol) or EVOH copolymer of roughly 2/10 to 5/10 mils in thickness. The advantage of the PVDC coating is that it is unaffected by moisture, whereas the EVOH, despite its superior barrier properties in the absence of moisture, must be protected on both sides by a moisture barrier. The oxygen permeability of EVOH escalates exponentially as it absorbs moisture. Still other oxygen barriers such as ultra-thin glass coatings presently being developed are also suitable for use in the invention. Another suitable oxygen barrier is an acrylonitrile-methyl methacrylate copolymer (such as Barex) which can be utilized in thicknesses of roughly 1–2 mils. Finally, the lidding film is preferably provided with an inner layer 25 which is comprised of polyethylene. In the preferred embodiment, polyethylene layer 25 is roughly about 1.5–2.5 mils in thickness.

The package of the present invention thus has suitable oxygen barrier properties so that it can be frozen, thawed to refrigeration temperatures and stored for a prolonged period of 2 weeks or more, and then microwaved to serving temperatures. It is preferred that a suitable oxygen barrier material be provided that has an oxygen permeability of no greater than about 1 cc of oxygen per 100 square inches per atmosphere at room temperature (about 25° C.). In previous packages which attempted freezer-to-microwave storage, such as that disclosed in U.S. Pat. No. 3,997,677 (Hirsch et al.) the materials employed did not provide a suitable oxygen barrier. As can be observed in Table 1, materials used in the Hirsh patent, such as polycarbonate, polypentamethylene, polysulfone, high and medium density polyethylene and polypropylene, do not provide suitable oxygen barrier properties. When compared with materials usable in the present invention, such as Saran, Eval (polyethylene vinyl alcohol copolymer) and Barex, the materials such as described in the Hirsch patent are several hundred times more oxygen permeable than the materials used in the present invention, which provides much more suitable oxygen impermiability.

Because of the vast superiority in terms of oxygen barrier properties and other features, the present invention provides a package having greater versatility and functionality than prior art packages. For example, the package of the present invention is suitable for use in refrigerated vending machines offering sandwiches or other rapidly perishable products. If the materials as described in the Hirsch patent were used in a vending machine, such a package would be unsuitable for this use because of the problems associated with the thawing of the package. Under these conditions, the thawed product would discolor rapidly, most likely within 2 hours (particularly if exposed to light) and the red surface of a wiener product would turn to tan and eventually gray as the cured meat pigment (nitrosomyoglobin) oxidizes to metmyoglobin. Even if held in the dark, the thawed product dispensed from refrigerated vending machines would be brown or gray in appearance and would suffer substantial flavor degradation as well. As indicated above, a further problem existed in that this type of prior art package also required a knife or other sharp object in order to be opened, and thus would be further unsuitable for use in a refrigerated vending machine. The package of the present invention thus overcomes all of the drawbacks associated with prior art models such as the one disclosed in the Hirsch et al. patent.

TABLE 1

| OXYGEN PERMEABILITY, 1 MIL FILMS IN CC PER 100 IN$^2$ PER ATMOSPHERE PRESSURE DIFFERENTIAL AT 25° C. | |
|---|---|
| POLYCARBONATE | 300 |
| POLYPENTAMETHYLENE | 400 |
| POLYSULFONE | 230 |
| HIGH DENSITY POLYETHYLENE | 185 |
| MEDIUM DENSITY POLYETHYLENE | 300 |
| POLYPROPYLENE | 200 |
| SARAN (POLYVINYLIDENE CHLORIDE COPOLYMER) | 1 |
| EVAL (POLYETHYLENE VINYL ALCOHOL COPOLYMER) | 3.3 |
| BAREX (ACRYLONITRILE | 0.8 |

TABLE 1-continued

| OXYGEN PERMEABILITY, 1 MIL FILMS IN CC PER 100 IN$^2$ PER ATMOSPHERE PRESSURE DIFFERENTIAL AT 25° C. |
|---|
| METHYL ACRYLATE COPOLYMER) |

In a second embodiment of the lidding film 12 used in the package 10 of the present invention, the outer layer 21 of lidding film may be comprised of Mylar (polyethylene terephthalate) having a thickness of about 0.3–0.7 mils. In this embodiment, it is preferred that the polyethylene inner layer 25 be roughly 3 to 5 times greater in thickness than the Mylar layer 21, and a suitable lidding film will have an overall thickness of roughly about 2 to 4 mils. A suitable film has been formed having a polyethylene layer of about 2 mils in thickness, a Mylar layer of about 0.5 mils in thickness, and a PVDC coating layer a thickness of roughly 0.1 mils. However, the exact dimensions of a particular lidding film will differ depending on the size of the actual package and the food product designed to be stored therein. Still other materials having similar physical properties can be used in constructing the lidding film of the present invention, as will be clear to one skilled in the art.

It is further the case that the sealing surface of the lidding film 12 should compatibly heat seal to the tray such that it permits peelable opening yet also discourages internal fogging. In the preferred embodiment, the modified polyethylene employed in the barrier film is a low density polyethylene which is readily heat sealed to the surface of package tray 15, yet which is also receptive to several different agents which can be added to reduce surface tension so as to eliminate or reduce fogging. Other surfaces which show similar heat seal properties and which are suitable for use in the invention include EVA or EVA copolymers and various heat seal coatings available from American National Can, Milprint, and the Laminating and Coating Corporation.

The peelable barrier film 16 of food compartment 14 is comprised of any suitable material which can substantially prevent the transmission of oxygen and moisture, and which can be hermetically and peelably sealed to the polypropylene copolymer 18. It is preferred that peelable oxygen barrier film 16, which is sealable or laminable by heat or adhesive to the copolymer layer 18, be comprised of any suitable material that provides an effective oxygen barrier, and which is sealable to the inner layer 25 of lidding film 12. As best observed in FIG. 2, the barrier film 16 is preferably made up of a laminable surface layer 27, an oxygen barrier layer 29 and a peelably sealable layer 31. It is particularly preferred that the laminable surface layer 27 be comprised of EVA (ethylene vinyl acetate), or other similar material, of about ½ to 3 mils in thickness, that the thin oxygen barrier layer 29 be made of PVDC or other suitable oxygen barrier material having a thickness of about 1/20 to 1/10 mils, and that the peelably sealable surface layer 31 be comprised of polyethylene, preferably modified polyethylene, with a preferred thickness of about ¼ to 3 mils. As indicated above with regard to the coating layer 23 of the lidding film 12, the oxygen barrier layer 29 may be comprised of a number of other suitable materials including EVOH, ultra-thin glass coatings, and Barex film.

With regard to laminable surface layer 27, this layer is preferably comprised of EVA because it can be readily heat laminated to polypropylene. However, other materials known in the art, such as polyolefinic copolymers that have similar physical properties to EVA, may also be used to form the laminable surface layer. The peelably sealable surface layer 29 is preferably made of polyethylene, and in particular modified polyethylene, but a wide variety of polyolefins with or without additives to improve peelability may also be employed. One peelable film that has particular suitability for the present invention is known as Vistal Pel or Sidac and is made by UCB, a European conglomerate. Additionally, peelable polyolefins, such as those which can be made from mixtures of polyethylene, EVA and polypropylene, are also suitable for the invention. Still further materials that can be used to make peelable layer 29 will include polybutenes, such as those made by Shell Chemical, and various compounds composed of DuPont Surlyns (Ionomers).

As indicated above, the packaging tray 15 of the present invention which defines food compartment 14 will preferably be comprised of a combination of polypropylene and polyethylene, such as a polypropylene copolymer. The preferred thickness for this material is roughly about 15–20 mil for a normal-sized wiener and bun package. When a roughly 2 mil peelable oxygen barrier film is laminated onto the polypropylene copolymer layer, it gives a tray formed from a material having a total thickness of roughly about 17–22 mil. However, the tray can be made with greater thickness as desired for a larger or heavier food item. As observed in FIG. 1, the embodiment shown has been thermoformed in a shape and size that will hold a frankfurter and bun combination, but the ultimate configuration of the package of the present invention is greatly variable and will depend on the dimensions of the food product to be enclosed.

The package 10 of the present invention, when sealed with a food product enclosed in food compartment 14, provides protection and utility for a perishable food product which will be held and shipped at freezing or below freezing temperatures (e.g., about 0° F.), thawed to refrigeration temperature near the point of sale, and held under refrigeration for up to about 10 to 14 days before microwaving and serving. The particular configuration as set forth in detail above provides a package that can withstand impact at temperatures around 0° F., that can exclude and prevent the permeation of oxygen and the loss of moisture, and that permits heating of the product in a microwave oven to serving temperature without deforming. The package of the present invention therefore provides a transparent, hermetic, easy-to-open gas-packed oxygen-barrier package for a perishable food product which is impact-resistant while frozen, yet ultimately microwavable as well.

The present invention is particularly advantageous in preventing deterioration of a proteinaceous-farinaceous food product, and the fact that the package is either entirely or partially transparent allows visual observation of the state of the food by the consumer. Because of the low temperature impact strength of the package of the invention, bread staling will be minimized because shipping and distribution can occur in the frozen state, and the degradation of the wiener or other meat product in the package is minimized because the package is hermetically sealed, gas-flushed and oxygen-impermeable. The present invention is thus highly advantageous in terms of consumer convenience because it provides a transparent package which permits freshness assessment, which is easy to open, and which can be microwaved to serving temperature without the package deforming or undergoing thermal distortion.

Although the invention is defined by the claims appended hereto, it will be apparent to one of ordinary skill in the art that there are many variations and alternative embodiments of the invention in addition to those described herein which fall within the scope of the invention.

What is claimed is:

1. A freezable and microwavable easy-to-open food package capable of containing a rapidly perishable food product that is visually assessable to the consumer prior to opening said package comprising:

a food product compartment capable of withstanding impact at low temperatures and capable of resisting deformation when microwaved, and which includes a peelable oxygen barrier film having an oxygen permeability of no greater than about 1 cc of oxygen per 100 square inches per atmosphere at room temperature, and a flexible lidding film hermetically and peelably sealed to said food product compartment, said lidding film capable of withstanding normal impact at low temperatures, capable of substantially preventing the transmission of oxygen and moisture, and capable of being heated while sealed to said food product compartment in a microwave oven without deformation.

2. A package according to claim 1 wherein said lidding film is comprised of a material selected from the group consisting of polyester and nylon.

3. A package according to claim 1 wherein said lidding film is comprised of oriented polyester.

4. A package according to claim 3 wherein said lidding film further comprises a coating layer which provides oxygen barrier properties.

5. A package according to claim 4 wherein said coating layer of said lidding film is comprised of a material selected from the group consisting of polyvinylidene dichloride, ethylene vinyl alcohol, ethylene vinyl alcohol copolymers, ultra-thin glass and acrylonitrile-methyl methacrylate copolymers.

6. A package according to claim 4 wherein said lidding film further comprises a layer of polyethylene.

7. A package according to claim 1 wherein said lidding film is comprised of polyethylene terephthalate.

8. A package according to claim 1 wherein said lidding film includes an anti-fogging agent.

9. A package according to claim 6 wherein said layer of polyethylene includes an anti-fogging agent.

10. A package according to claim 1 wherein said lidding film is heat sealed to said food product compartment.

11. A package according to claim 6 wherein said lidding film is heat sealed to said food product compartment with the polyethylene layer contacting the food product compartment.

12. A package according to claim 1 wherein the food product compartment is formed into a tray having a peripheral flange which provides a surface for attachment of said lidding film to said compartment.

13. A package according to claim 1 wherein said food compartment is transparent.

14. A package according to claim 1 wherein said lidding film is transparent.

15. A package according to claim 1 wherein said food product compartment is comprised of a polypropylene copolymer.

16. A package according to claim 1 wherein said food product compartment is comprised of polyethylene and polypropylene.

17. A package according to claim 1 wherein said food product compartment is comprised of a material selected from the group consisting of polycarbonates, cellulose acetate-butyrate and ethocell.

18. A package according to claim 1 wherein said peelable oxygen barrier film is comprised of a laminable surface layer, an oxygen barrier layer and a peelably sealable surface layer.

19. A package according to claim 18 wherein said laminable surface layer comprises ethylene vinyl acetate or a polyolefinic copolymer, wherein said oxygen barrier comprises a material selected from the group consisting of polyvinylidene dichloride, ethylene vinyl alcohol, ethylene vinyl alcohol copolymers, ultra-thin glass and acrylonitrile-methyl methacrylate copolymers, and wherein said peelably sealable surface layer is selected from the group consisting of polyethylene, modified polyethylene, peelable polyolefins and polybutenes.

20. A package according to claim 1 wherein said food product compartment is shaped so as to enclose a wiener in a bun.

21. A package according to claim 1 wherein said food product compartment is gas-flushed before said lidding film is sealed thereto.

22. A package according to claim 1 wherein said food product compartment is preformed using a multiple unit thermoformer.

23. An easy-to-open food package for a combination proteinaceous and farinaceous food product capable of maintaining the freshness of the food product at low temperatures while also being capable of withstanding microwave heating sufficient to heat the food product without thermal distortion and capable of having said food product visually assessed by the consumer while in said package, comprising:

a food product compartment shaped to accommodate the food product having an upper opening, said compartment capable of withstanding impact at low temperatures so as to protect the food product and capable of withstanding microwaving without thermal degradation, and including a peelable oxygen barrier film having an oxygen permeability of no greater than about 1 cc of oxygen per 100 square inches per atmosphere at room temperature, and a flexible lidding film hermetically and peelably sealed to the upper opening of said food product compartment, said lidding film capable of withstanding microwaving while remaining sealed to said food product compartment without thermal degradation, capable of withstanding impact at low temperatures, and comprising an oxygen and moisture barrier to prevent degradation of the proteinaceous and farinaceous food product at low temperatures.

24. A package according to claim 23 wherein said food product compartment is comprised of a polypropylene copolymer.

25. A package according to claim 23 wherein said lidding film is comprised of a material selected from the group consisting of polyester and nylon.

26. A package according to claim 23 wherein the food product compartment is formed into a tray having a peripheral flange which provides a surface for attachment of said lidding film to said compartment.

27. A package according to claim 23 wherein said food product compartment is shaped so as to enclose a wiener in a bun.

28. A package according to claim 25 wherein said lidding film further comprises a coating layer which provides oxygen barrier properties.

29. A package according to claim 23 wherein said food compartment is transparent.

30. A package according to claim 23 wherein said lidding film is transparent.

* * * * *